US011474463B2

(12) United States Patent
Nakamoto et al.

(10) Patent No.: US 11,474,463 B2
(45) Date of Patent: Oct. 18, 2022

(54) FIXING DEVICE AND IMAGE FORMING APPARATUS CAPABLE OF PROMOTING CIRCULATION OF LUBRICANT

(71) Applicant: KYOCERA Document Solutions Inc., Osaka (JP)

(72) Inventors: Fumito Nakamoto, Osaka (JP); Masakazu Uehara, Osaka (JP); Tomohiro Watatani, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/341,956

(22) Filed: Jun. 8, 2021

(65) Prior Publication Data

US 2021/0382424 A1 Dec. 9, 2021

(30) Foreign Application Priority Data

Jun. 9, 2020 (JP) ..... JP2020-100086

(51) Int. Cl.
*G03G 15/20* (2006.01)

(52) U.S. Cl.
CPC ..... *G03G 15/2053* (2013.01); *G03G 15/2025* (2013.01); *G03G 15/2064* (2013.01); *G03G 2215/2038* (2013.01)

(58) Field of Classification Search
CPC ..... G03G 15/2025; G03G 15/2064; G03G 2215/2035
See application file for complete search history.

(56) References Cited

U.S. PATENT DOCUMENTS

2001/0019676 A1* 9/2001 Okubo ..... G03G 15/2064 399/329
2017/0219969 A1 8/2017 Umeda et al.

FOREIGN PATENT DOCUMENTS

JP 2006078965 A * 3/2006
JP 4599189 B2 12/2010
JP 2011033654 A 2/2011

OTHER PUBLICATIONS

Translation of JP-2006078965 (Year: 2006).*

* cited by examiner

*Primary Examiner* — Arlene Heredia
(74) *Attorney, Agent, or Firm* — Alleman Hall Creasman & Tuttle LLP

(57) ABSTRACT

A fixing device includes a fixing belt, a pressure applying member, and a heater holding member. The fixing belt fixes toner to a sheet. The pressure applying member forms a nip portion together with an outer peripheral surface of the fixing belt and causes the fixing belt to peripherally rotate while applying pressure to the fixing belt at the nip portion. The heater holding member holds a heater that applies heat to the fixing belt. The heater holding member includes: a side portion that extends from the nip portion along an inner peripheral surface of the fixing belt and guides the fixing belt; and a plurality of inclined ribs that are disposed on the side portion to face the inner peripheral surface and formed such that an interval between them is gradually narrowed as they proceed in a direction in which the fixing belt peripherally rotates.

7 Claims, 8 Drawing Sheets

FIXING DEVICE AND IMAGE FORMING APPARATUS CAPABLE OF PROMOTING CIRCULATION OF LUBRICANT

INCORPORATION BY REFERENCE

This application is based upon and claims the benefit of priority from the corresponding Japanese Patent Application No. 2020-100086 filed on Jun. 9, 2020, the entire contents of which are incorporated herein by reference.

BACKGROUND

The present disclosure relates to a fixing device and an image forming apparatus.

There is known an image heating device that processes the lubricant with a configuration where a projection portion is provided on either of the upstream side and the downstream side of a heater guide in the rotation direction of a fixing film.

SUMMARY

A fixing device according to an aspect of the present disclosure includes a fixing belt, a pressure applying member, and a heater holding member. The fixing belt is configured to fix toner to a sheet. The pressure applying member forms a nip portion together with an outer peripheral surface of the fixing belt and causes the fixing belt to peripherally rotate while applying pressure to the fixing belt at the nip portion. The heater holding member holds a heater that applies heat to the fixing belt. The heater holding member includes a side portion and a plurality of inclined ribs. The side portion extends from the nip portion along an inner peripheral surface of the fixing belt and guides the fixing belt. The plurality of inclined ribs are disposed on the side portion to face the inner peripheral surface and are formed such that an interval between the inclined ribs is gradually narrowed as the inclined ribs proceed in a direction in which the fixing belt peripherally rotates.

An image forming apparatus according to another aspect of the present disclosure includes the fixing device described above and an image forming portion. The image forming portion is configured to form an image on the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiment 1

Figure 1:
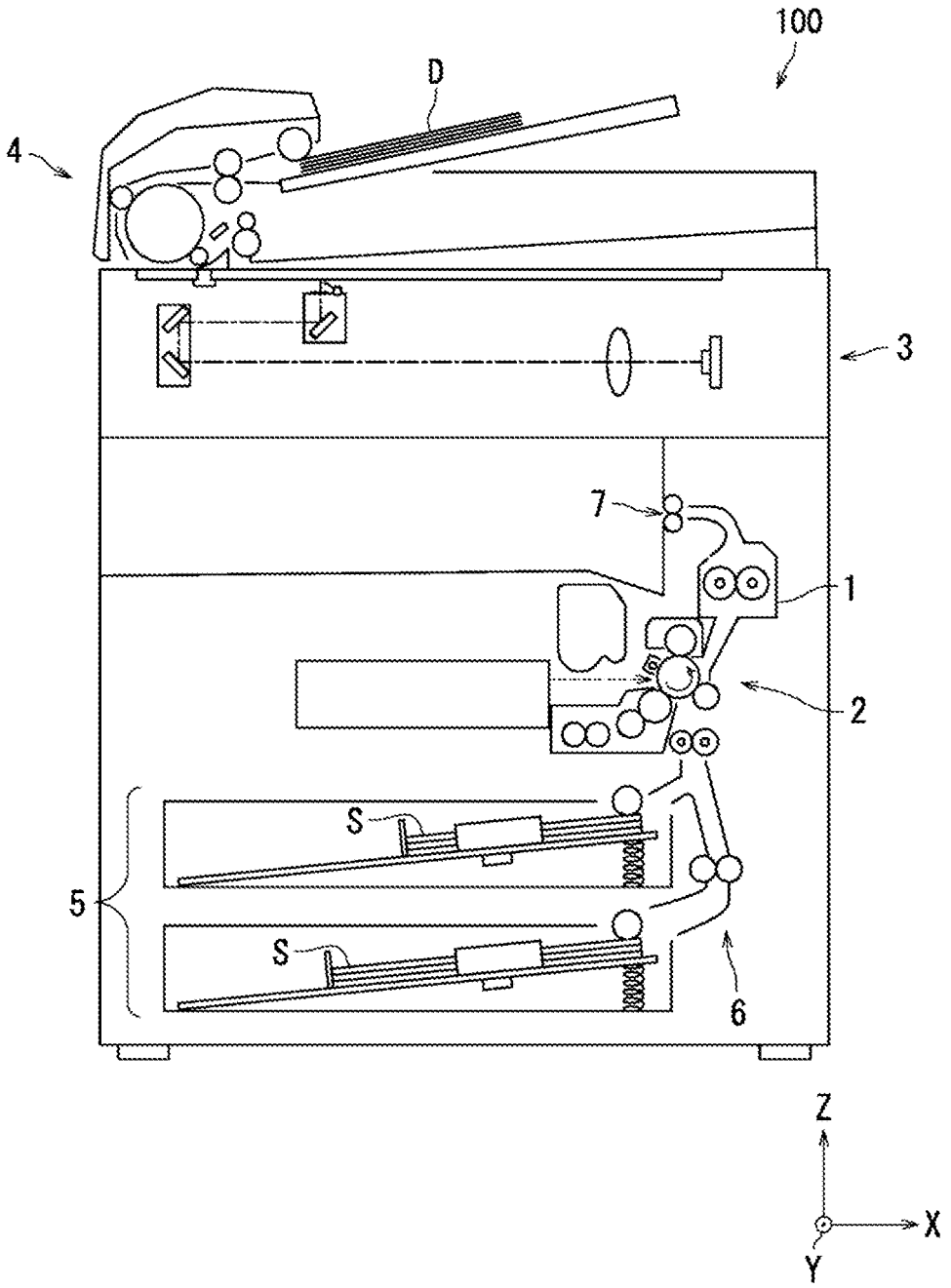
FIG. 1 is a diagram showing an image forming apparatus including a fixing device according to Embodiment 1 of the present disclosure.

The following describes Embodiment 1 of the present disclosure with reference to the accompanying drawings. It is noted that in the drawings, same or similar portions are assigned the same reference signs, and the explanation is not repeated. In addition, in Embodiment 1, X-axis, Y-axis, and Z-axis that are perpendicular to each other are shown in the drawings. The Z-axis is parallel to a vertical plane, and the X-axis and the Y-axis are parallel to a horizontal plane.

The following describes an image forming apparatus 100 according to Embodiment 1 of the present disclosure with reference to FIG. 1. FIG. 1 shows the image forming apparatus 100 according to Embodiment 1. The image forming apparatus 100 is, for example, a copier, a facsimile, or a multifunction peripheral having functions of these. In Embodiment 1, the image forming apparatus 100 is a monochrome multifunction peripheral.

As shown in FIG. 1, the image forming apparatus 100 includes a fixing device 1, an image forming portion 2, a reading portion 3, a document sheet conveyance portion 4, a sheet feed portion 5, a conveyance portion 6, and a discharge portion 7.

The reading portion 3 reads an image of a document sheet D. The reading portion 3 generates image data from the read image. The document sheet conveyance portion 4 conveys the document sheet D to the reading portion 3. The sheet feed portion 5 stores a plurality of sheets S, and feeds a sheet S to the conveyance portion 6. The sheet S is made from, for example, paper or synthetic resin. The sheet S is an example of a recording medium. The conveyance portion 6 includes a plurality of pairs of conveyance rollers, and conveys the sheet S to the discharge portion 7 via the image forming portion 2.

The image forming portion 2 forms a toner image T (FIG. 3) on the sheet S by an electrophotographic method based on image data. The image data represents, for example, an image of the document sheet D. The image forming portion 2 includes, for example, a photoconductor drum, a charging device, an exposure device, a developing device, a replenishing device, a transfer roller, a cleaning device, and an electricity removing device.

The fixing device 1 applies heat and pressure to the toner image T to fix the toner image T to the sheet S. The conveyance portion 6 conveys the sheet S with the toner image T fixed thereto to the discharge portion 7. The discharge portion 7 discharges the sheet S to outside the housing of the image forming apparatus 100.

Figure 2:
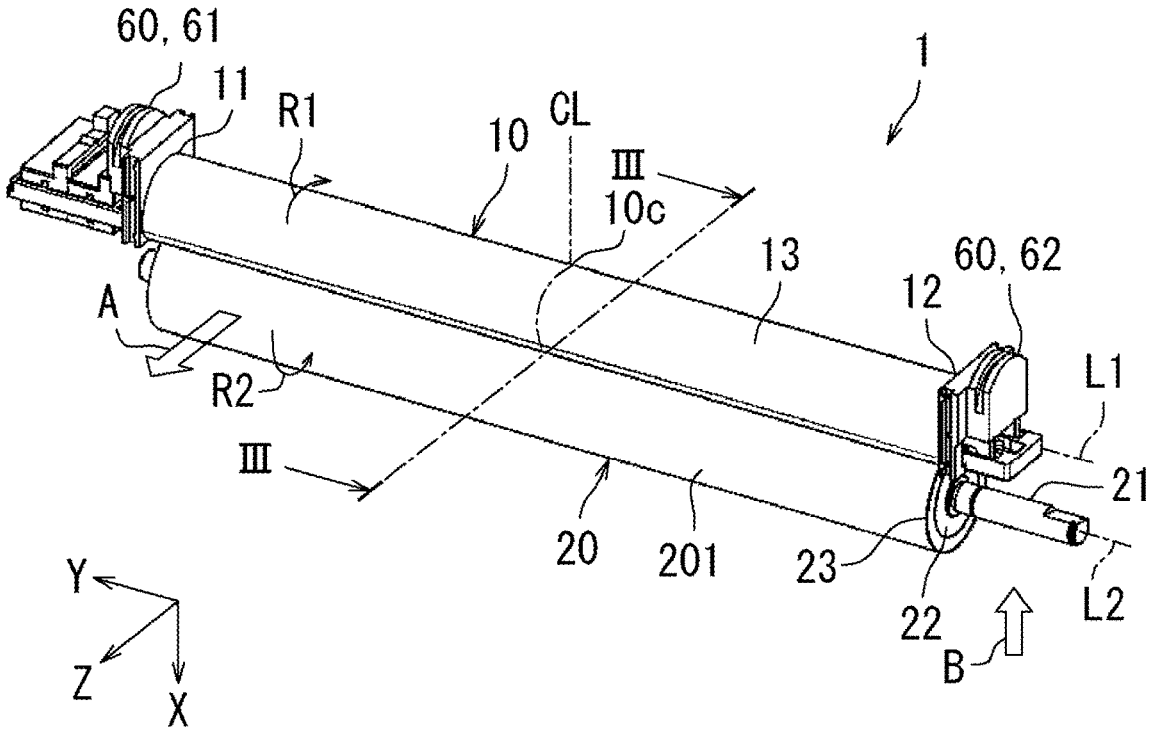
FIG. 2 is a perspective diagram showing a main part of the fixing device according to Embodiment 1.
Figure 3:
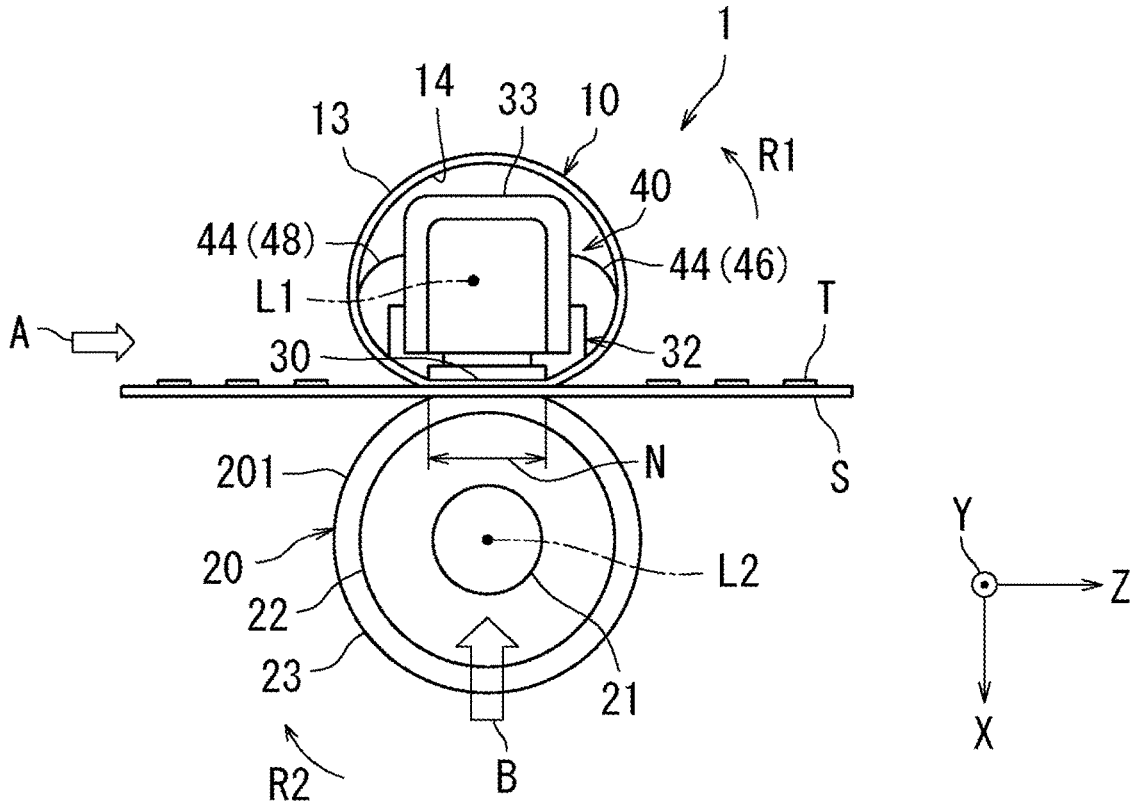
FIG. 3 is a cross-section diagram taken along a line of FIG. 2.

Next, the following describes a detailed configuration of the fixing device 1 according to Embodiment 1 with reference to FIG. 2 and FIG. 3. FIG. 2 is a perspective diagram showing a main part of the fixing device 1 according to Embodiment 1. FIG. 3 is a cross-section diagram taken along a line of FIG. 2.

Figure 4:
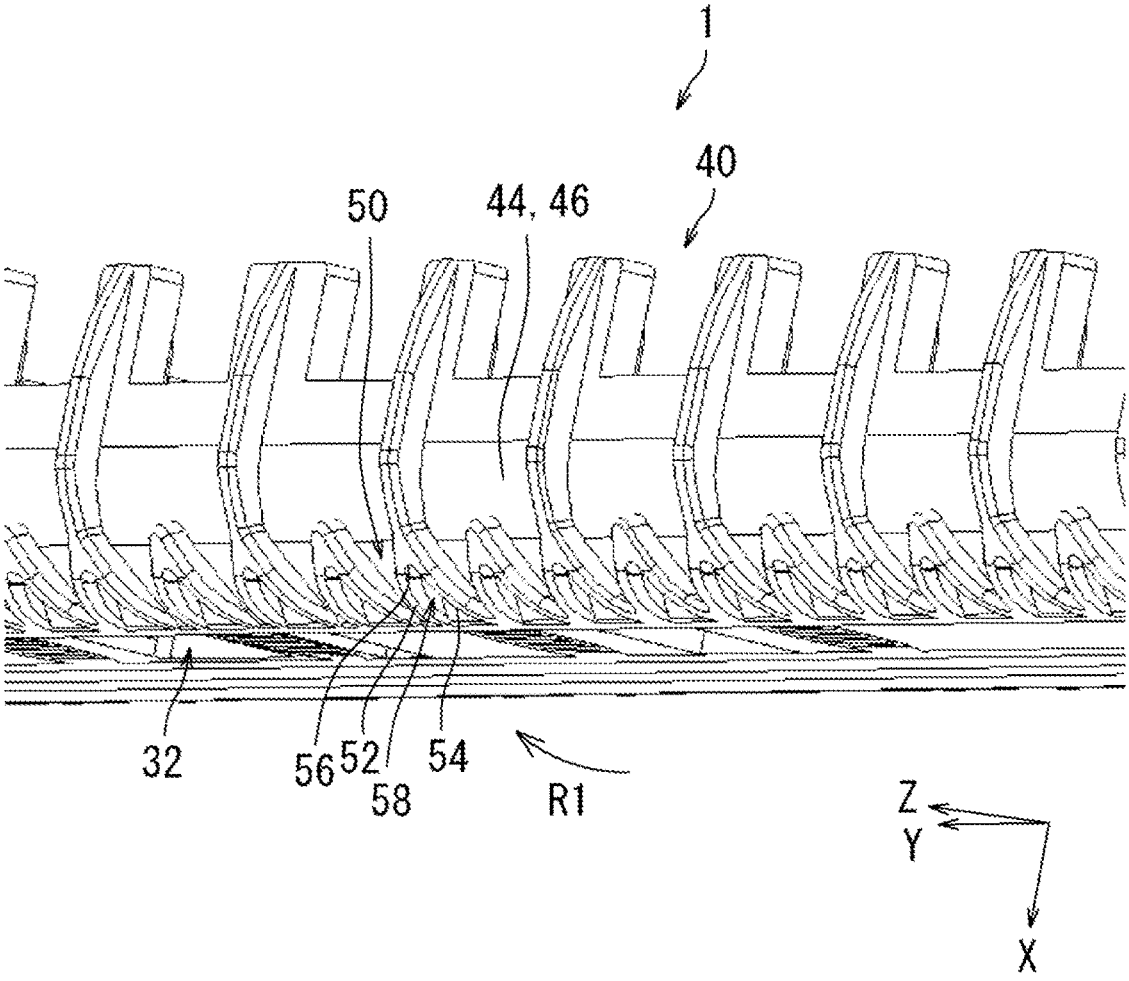
FIG. 4 is an outline perspective diagram of a heater holding member provided in the fixing device according to Embodiment 1.
Figure 5:
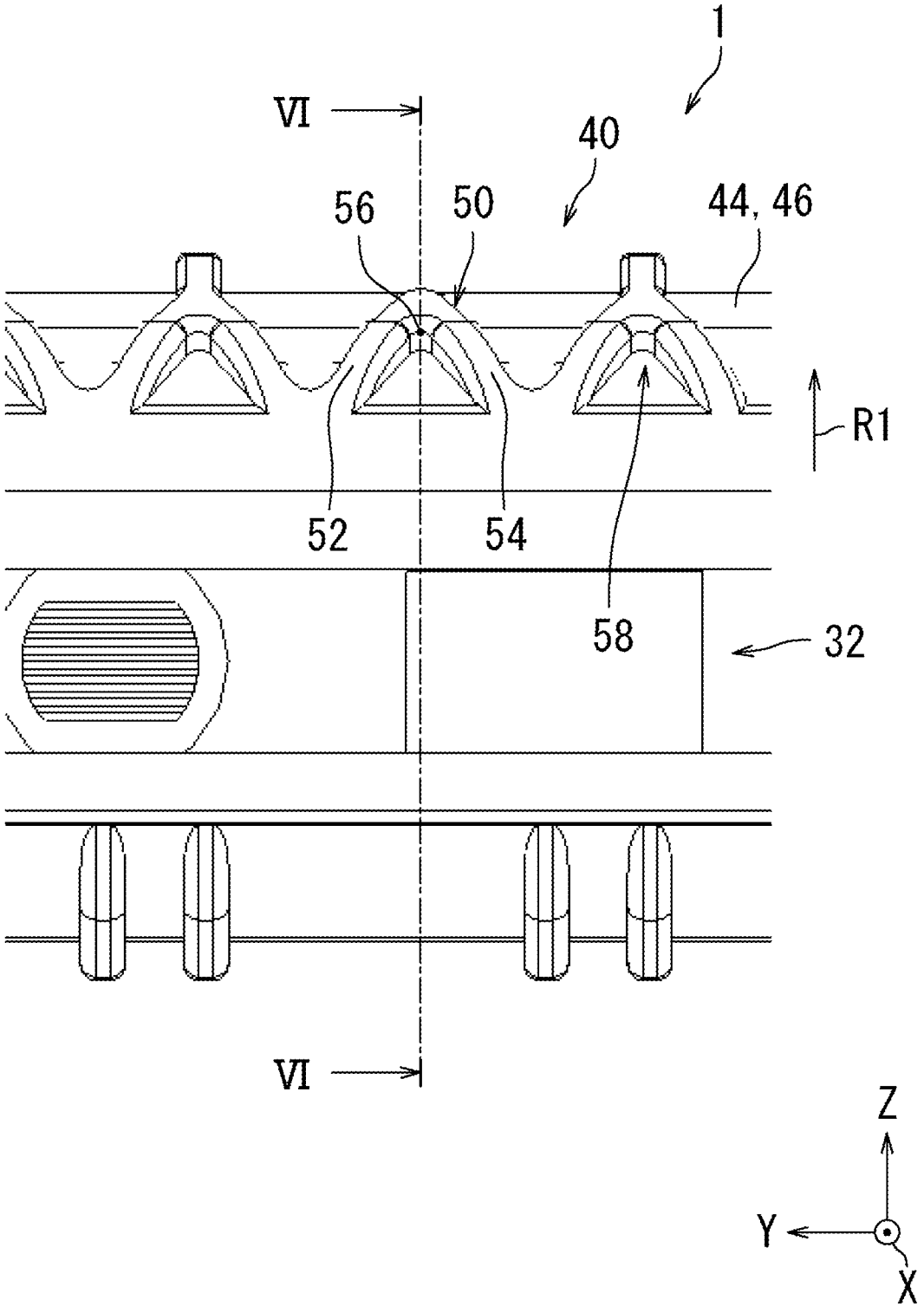
FIG. 5 is a diagram of the heater holding member of the fixing device according to Embodiment 1 viewed from a positive side of X-axis.
Figure 6A:
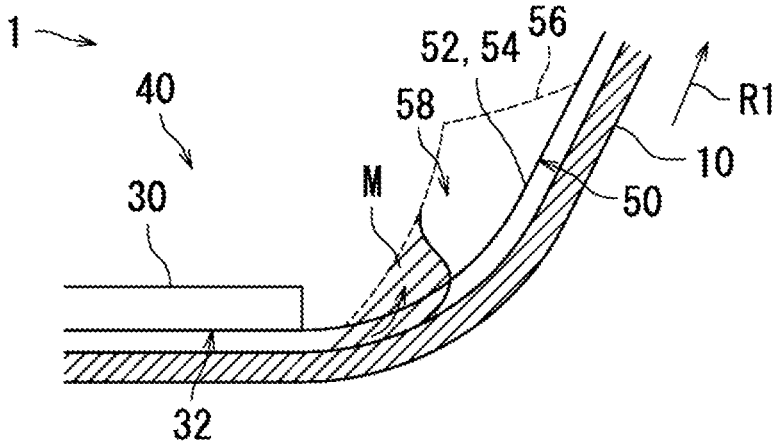
FIG. 6A is a diagram showing the behavior of lubricant in the heater holding member of the fixing device according to Embodiment 1.
Figure 6B:
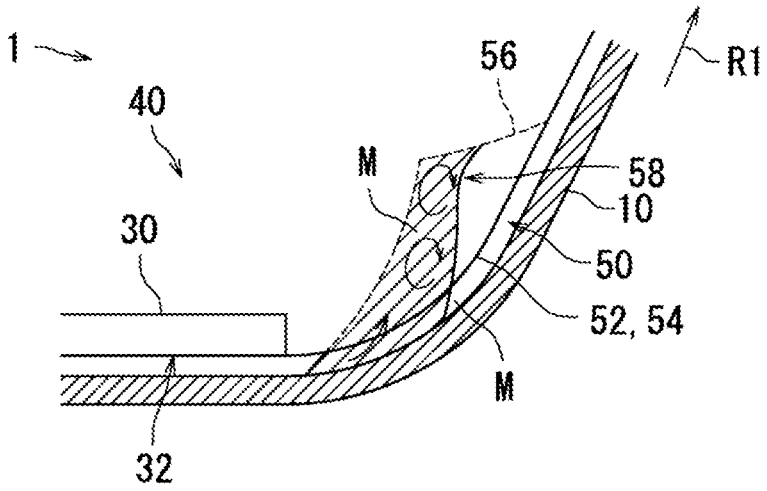
FIG. 6B is a diagram showing the behavior of lubricant in the heater holding member of the fixing device according to Embodiment 1.
Figure 6C:
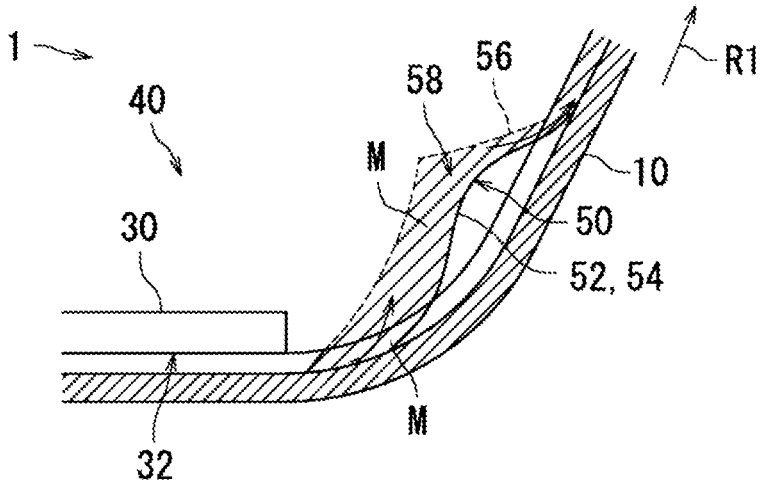
FIG. 6C is a diagram showing the behavior of lubricant in the heater holding member of the fixing device according to Embodiment 1.

FIG. 4 is an outline perspective diagram of a heater holding member 40 provided in the fixing device 1 according to Embodiment 1. FIG. 5 is a diagram of the heater holding member 40 of the fixing device 1 according to Embodiment 1 viewed from the positive side of the X-axis. FIG. 6A, FIG. 6B, and FIG. 6C show the behavior of lubricant M in the heater holding member 40 of the fixing device 1 according to Embodiment 1.

As shown in FIG. 2 and FIG. 3, in Embodiment 1, the fixing device 1 includes a fixing belt 10, a pressure applying member 20, and the heater holding member 40.

As shown in FIG. 2 and FIG. 3, the fixing belt 10 fixes the toner image T to the sheet S. The pressure applying member 20 forms a nip portion N together with an outer peripheral surface 13 of the fixing belt 10, and causes the fixing belt 10 to peripherally rotate by applying pressure to the fixing belt 10 at the nip portion N. The heater holding member 40 holds a heater 30. The heater holding member 40 includes a side portion 44 and inclined ribs (52, 54).

As shown in FIG. 4 and FIG. 5, the side portion 44 extends from the nip portion N along an inner peripheral surface 14 of the fixing belt 10, and guides the fixing belt 10. The plurality of inclined ribs 52 and 54 are disposed on the side portion 44 to face the inner peripheral surface 14 of the fixing belt 10, and are formed such that the interval between them is gradually narrowed as they proceed in a direction R1 in which the fixing belt 10 peripherally rotates.

As shown in FIG. 4 and FIG. 5, in Embodiment 1, the heater holding member 40 further includes a joint rib 50 where the plurality of inclined ribs (52, 54) join.

As shown in FIG. 4 and FIG. 5, in Embodiment 1, the heater holding member 40 includes a storage portion 58 formed between the plurality of inclined ribs (52, 54) to store the lubricant M.

As shown in FIG. 6A to FIG. 6C, in Embodiment 1, the plurality of inclined ribs (52, 54) include a joint portion 56 that is configured such that the lubricant M accumulates therein, and the joint portion 56 supplies the lubricant M to the fixing belt 10.

As shown in FIG. 6A to FIG. 6C, in Embodiment 1, the joint portion 56 of the fixing device 1 is inclined toward the downstream in the direction R1 in which the fixing belt 10 peripherally rotates.

As shown in FIG. 4, in Embodiment 1, the side portion 44 includes a downstream side portion 46 extending from the nip portion N toward the downstream in the direction R1 in which the fixing belt 10 peripherally rotates, and the plurality of inclined ribs (52, 54) are disposed on the downstream side portion 46.

In the following, a detailed description is given with reference to FIG. 2 to FIG. 6C. As shown in FIG. 2, the fixing device 1 includes the fixing belt 10, the pressure applying member 20, and the heater holding member 40.

The fixing belt 10 fixes the toner image T to the sheet S. That is, the fixing belt 10 is heated by the heater 30 described below and biased by the pressure applying member 20 such that the toner image T is fixed to the sheet S while the sheet S passes through the nip portion N between the fixing belt 10 and the pressure applying member 20.

The fixing belt 10 is endless. The fixing belt 10 is approximately cylindrical in shape. The fixing belt 10 is flexible. The fixing belt 10 is configured to peripherally rotate around a first rotation axis line L1. The fixing belt 10 extends along the first rotation axis line L1.

The fixing belt 10 includes an end portion 11, an end portion 12, an outer peripheral surface 13, and an inner peripheral surface 14. The end portions 11 and 12 are opposite ends of the fixing belt 10 in the direction along the first rotation axis line L1. In the following description, the direction along the first rotation axis line L1 may be denoted as "rotation axis direction", "rotation axis direction of the fixing belt 10", or "width direction of the fixing belt 10". In addition, a middle (center) 10*c* of the fixing belt 10 in the rotation axis direction may be denoted as "middle 10*c* of the belt". In addition, the middle 10*c* may be denoted as "center 10*c*". Furthermore, an imaginary line that passes through the middle 10*c* of the belt may be denoted as a middle line CL. The middle line CL may be denoted as "center line CL".

The fixing belt 10 further includes a plurality of layers. The fixing belt 10 includes, for example, a polyimide layer and a release layer. The release layer is formed on the outer peripheral surface of the polyimide layer. The release layer is, for example, a heat-resistant film made of fluororesin.

FIG. 3 is a cross-section diagram taken along a line of FIG. 2. As shown in FIG. 3, the pressure applying member 20 forms the nip portion N that is in close contact with the outer peripheral surface 13 of the fixing belt 10. The pressure applying member 20 causes the fixing belt 10 to peripherally rotate while applying pressure to the fixing belt 10 at the nip portion N. The pressure applying member 20 is approximately cylindrical and disposed to face the fixing belt 10. The pressure applying member 20 includes an outer peripheral surface 201. The pressure applying member 20 applies pressure to the fixing belt 10. This causes the outer peripheral surface 201 of the pressure applying member 20 to abut on the outer peripheral surface 13 of the fixing belt 10 to form the nip portion N.

The pressure applying member 20 is freely rotatable around a second rotation axis line L2 as its axial center. When the pressure applying member 20 rotates, the fixing belt 10 rotates following the pressure applying member 20. With these configurations, when the sheet S passes through the nip portion N, the toner image T is fixed to the sheet S. It is noted that the sheet S is conveyed in a direction A (the positive side of the Z-axis). The pressure applying member 20 extends along the second rotation axis line L2. It is noted that the second rotation axis line L2 and the first rotation axis line L1 are approximately parallel to each other.

The pressure applying member 20 includes a columnar metal core 21, a cylindrical elastic layer 22, and a release layer 23. The elastic layer 22 is formed on the metal core 21. The release layer 23 is formed to cover the surface of the elastic layer 22. The metal core 21 is freely rotatable around the second rotation axis line L2 as its axial center. The metal core 21 is formed from, for example, stainless or aluminum. The elastic layer 22 is elastic, and is formed from, for example, silicone rubber. The release layer 23 is formed from, for example, fluororesin.

The heater holding member 40 holds the heater 30. As shown in FIG. 2, the heater holding member 40 includes a belt holding member 60. The belt holding member 60 includes a first belt holding member 61 and a second belt holding member 62. The first belt holding member 61 holds the end portion 11 of the fixing belt 10. The second belt holding member 62 holds the end portion 12 of the fixing belt 10.

As shown in FIG. 3, the fixing belt 10 further includes an inner peripheral surface 14. In addition, the heater holding member 40 includes a heater holding portion 32.

The heater holding portion 32 includes a reinforcement member 33 and the heater 30. Specifically, the inner peripheral surface 14 of the fixing belt 10 faces the heater 30.

The reinforcement member 33 is configured to reinforce the heater holding member 40. The reinforcement member 33 is, for example, an elongated metal stay member. The reinforcement member 33 is, when viewed from the positive side of the Y-axis, approximately in the shape of inverted letter U. The reinforcement member 33 extends along the first rotation axis line L1.

The heater 30 heats the fixing belt 10. The heater 30 extends along the first rotation axis line L1. The heater 30 is, for example, a surface heater or an elongated thin-plate heater. The heater 30 is, for example, a ceramic heater, and includes a ceramic substrate and a heating resistor. The heater 30 is, for example, 1 mm thick. The heater 30 receives a pressure from the pressure applying member 20 via the fixing belt 10.

The heater holding portion 32 of the heater holding member 40 holds the heater 30. The heater holding portion 32 faces the fixing belt 10 across the heater 30. The heater holding member 40 is disposed inside the fixing belt 10 to face the pressure applying member 20 (on the opposite side from the outer peripheral surface 13 facing the pressure applying member 20). The heater holding member 40 is made from, for example, heat-resistant resin. The heater holding member 40 extends along the first rotation axis line L1. One of opposite ends of the heater holding member 40 in the direction along the first rotation axis line L1 is configured to fit to a connector provided in the main body of the image forming apparatus 100.

Meanwhile, there is known an image heating device that processes the lubricant with a configuration where a projection portion is provided on either of the upstream side and the downstream side of a heater guide in the rotation direction of a fixing film.

However, the above-mentioned image heating device has a problem that the lubricant accumulates on, for example, side walls of the projection portions and is deposited.

On the other hand, the fixing device 1 of Embodiment 1 is configured to prevent deposition of the lubricant between the ribs and promote circulation of the lubricant, as described in the following.

As shown in FIG. 4, the heater holding member 40 includes the side portion 44, the inclined rib 52, and the inclined rib 54.

The side portion 44 guides the fixing belt 10 (FIG. 3) to peripherally rotate. The side portion 44 extends from opposite sides of the heater holding member 40 in its short direction, along the inner peripheral surface 14 of the fixing belt 10.

As shown in FIG. 3 and FIG. 4, the side portion 44 includes a downstream side portion 46 and an upstream side portion 48.

The downstream side portion 46 extends from the nip portion N of the heater holding member 40 along the inner peripheral surface 14 of the fixing belt 10 toward the downstream in the direction R1 in which the fixing belt 10 peripherally rotates.

The upstream side portion 48 extends from the nip portion N of the heater holding member 40 along the inner peripheral surface 14 of the fixing belt 10 toward the upstream in the direction R1 in which the fixing belt 10 peripherally rotates.

As shown in FIG. 4, the plurality of inclined ribs 52 and 54 are disposed on the side portion 44 to face the inner peripheral surface 14 of the fixing belt 10, and are formed such that the interval between them is gradually narrowed as they proceed in a direction R1 in which the fixing belt 10 peripherally rotates.

The plurality of inclined ribs 52 and 54 of the heater holding member 40 are disposed on the downstream side portion 46.

The heater holding member 40 includes the storage portion 58 formed between the inclined rib 52 and the inclined rib 54 to store the lubricant M.

Specifically, the inclined rib 52 and the inclined rib 54 are disposed at least on the downstream side portion 46 of the heater holding member 40 to face the inner peripheral surface 14 of the fixing belt 10. The inclined rib 52 and the inclined rib 54 adjacent to each other are formed such that the interval between them is gradually narrowed as they proceed in a direction R1 in which the fixing belt 10 peripherally rotates.

It is preferable that a plurality of inclined ribs 52 and a plurality of inclined ribs 54 are provided. However, the present disclosure is not limited to the configuration where the plurality of inclined ribs 52 and the plurality of inclined ribs 54 are provided. In addition, the inclined rib 52 and the inclined rib 54 adjacent to each other may not join.

The heater holding member 40 includes the storage portion 58 formed between the inclined rib 52 and the inclined rib 54 to store the lubricant M.

Next, the behavior of lubricant M in the heater holding member 40 is described with reference to FIG. 6A, FIG. 6B, and FIG. 6C. In a case where the inclined rib 52 and the inclined rib 54 adjacent to each other are formed not to join, when the fixing belt 10 peripherally rotates in the direction R1, as shown in FIG. 6A, the lubricant M applied to the inner peripheral surface 14 of the fixing belt 10 abuts on, and is collected by, the inclined rib 52 or the inclined rib 54.

As the fixing belt 10 further peripherally rotates, the lubricant M is stored and accumulated in the storage portion 58 between the inclined rib 52 and the inclined rib 54. Furthermore, due to the configuration where the interval between the inclined rib 52 and the inclined rib 54 adjacent to each other is gradually narrowed, as shown in FIG. 6B, the lubricant M is pushed out in the direction R1 of the inclined rib 52 and the inclined rib 54, and accumulates in the joint portion 56 while being circulated.

Even in a case where the inclined rib 52 and the inclined rib 54 adjacent to each other are formed not to join, the joint portion 56 may be a region where the inclined rib 52 and the inclined rib 54 adjacent to each other are most close to each other.

As shown in FIG. 6C, the lubricant M that has accumulated in the joint portion 56 is pushed out by the lubricant M supplied later, overflows from the joint portion 56, and is re-supplied to the inner peripheral surface 14 of the fixing belt 10.

According to the present embodiment, the lubricant M stored in the joint portion 56 is not deposited between the inclined rib 52 and the inclined rib 54, but is re-supplied to the inner peripheral surface 14 of the fixing belt 10. As a result, it is possible to suitably circulate the lubricant M between the fixing belt 10 and the heater holding member 40 and prevent coagulation of the lubricant M.

According to the present embodiment, the storage portion 58 formed between the inclined rib 52 and the inclined rib 54 is configured to store the lubricant M applied to the inner peripheral surface 14 of the fixing belt 10.

According to the present embodiment, it is possible to re-supply the lubricant M from the joint portion 56 where the inclined rib 52 and the inclined rib 54 adjacent to each other come closest to each other, to the inner peripheral surface 14 of the fixing belt 10. As a result, it is possible to suitably circulate the lubricant M between the fixing belt 10 and the heater holding member 40 and prevent coagulation of the lubricant M.

Next, as shown in FIG. 4 and FIG. 5, the heater holding member 40 may further include the joint rib 50 where the inclined rib 52 and the inclined rib 54 join.

The joint rib 50 is formed such that the inclined rib 52 and the inclined rib 54 approach each other as they proceed in the direction R1 in which the fixing belt 10 peripherally rotates, and join at the joint portion 56.

The joint rib 50 includes the storage portion 58 to store the lubricant M in a space between the inclined rib 52 and the inclined rib 54.

The joint rib 50 includes the joint portion 56 at which the inclined rib 52 and the inclined rib 54 join. At the joint portion 56, the lubricant M stored in the storage portion 58 accumulates. The joint portion 56 supplies the lubricant M to the fixing belt 10.

Next, the behavior of lubricant M in the heater holding member 40 is described with reference to FIG. 6A, FIG. 6B, and FIG. 6C. As shown in FIG. 6A, when the fixing belt 10 peripherally rotates in the direction R1, the lubricant M applied to the inner peripheral surface 14 of the fixing belt 10 comes in contact with the joint rib 50, and is collected by the inclined rib 52 or the inclined rib 54 of the joint rib 50.

As the fixing belt 10 further peripherally rotates, the lubricant M is stored and accumulates in the storage portion 58 between the inclined rib 52 and the inclined rib 54. Due to the configuration where the interval between the inclined rib 52 and the inclined rib 54 adjacent to each other is gradually narrowed, as shown in FIG. 6B, the lubricant M is pushed out in the direction R1 of the inclined rib 52 and the inclined rib 54, and accumulates in the joint portion 56 while being circulated.

As shown in FIG. 6C, the lubricant M that has accumulated in the joint portion 56 is pushed out by the lubricant M supplied later, overflows from the joint portion 56, and is re-supplied to the inner peripheral surface 14 of the fixing belt 10.

Furthermore, as shown in FIG. 6C, the joint portion 56 may be inclined toward the downstream in the direction R1 in which the fixing belt 10 peripherally rotates.

According to the present embodiment, the lubricant M stored in the storage portion 58 of the joint rib 50 is not deposited between the inclined rib 52 and the inclined rib 54, but is re-supplied from the joint portion 56 to the inner peripheral surface 14 of the fixing belt 10. As a result, it is possible to suitably circulate the lubricant M between the fixing belt 10 and the heater holding member 40 and prevent coagulation of the lubricant M.

According to the present embodiment, with the configuration where the joint portion 56 is inclined toward the downstream in the direction R1 in which the fixing belt 10 peripherally rotates, the lubricant M is further suitably re-supplied from the joint portion 56 to the inner peripheral surface 14 of the fixing belt 10. As a result, it is possible to prevent coagulation of the lubricant M.

Furthermore, according to the present embodiment, the plurality of inclined ribs 52 and 54 are disposed on the downstream side portion 46. With this configuration, it is possible to suitably reduce the friction between the fixing belt 10 that passes through the nip portion N and the heater holding member 40, and suitably circulate the lubricant M between the fixing belt 10 and the heater holding member 40.

Embodiment 2

Next, the side portion 44 includes the upstream side portion 48 extending from the nip portion N toward the upstream in the direction R1 in which the fixing belt 10 peripherally rotates, and the joint rib 50 and the inclined rib 52 and the inclined rib 54 constituting the joint rib 50 are disposed on the upstream side portion 48.

Figure 7:
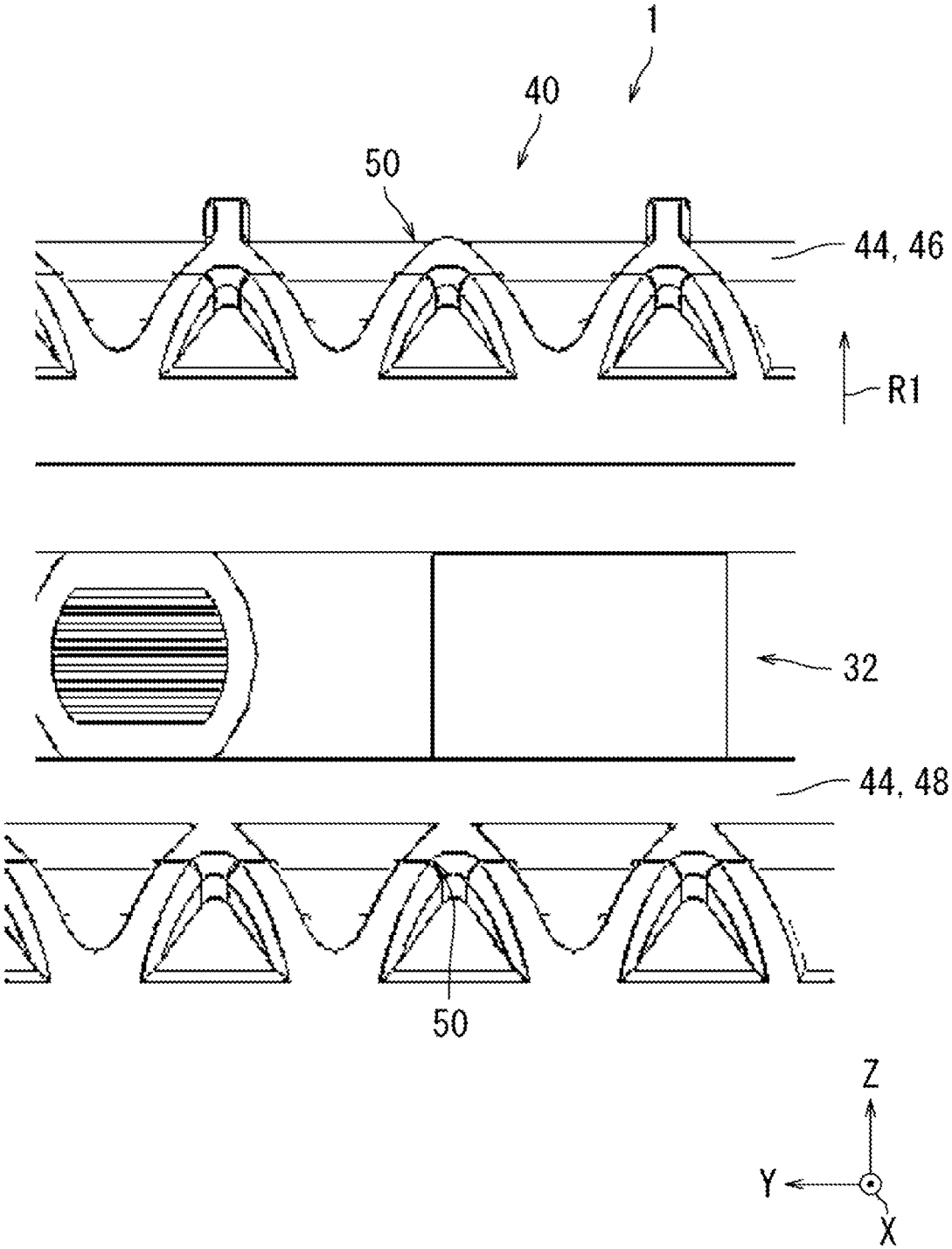
FIG. 7 is a diagram of the heater holding member of the fixing device according to Embodiment 2 viewed from the positive side of the X-axis.

As shown in FIG. 7, the heater holding member 40 includes the upstream side portion 48 that extends from the nip portion N of the heater holding member 40 along the inner peripheral surface 14 of the fixing belt 10 toward the upstream in the direction R1 in which the fixing belt 10 peripherally rotates.

The joint rib 50 may be disposed on the upstream side portion 48. The joint rib 50 may be disposed only on the upstream side portion 48, not disposed on the downstream side portion 46. The joint rib 50 may be disposed on both the downstream side portion 46 and the upstream side portion 48.

After passing through the downstream side portion 46, the fixing belt 10 peripherally rotates without restraint relatively for a long time. As a result, the lubricant M applied to the inner peripheral surface 14 of the fixing belt 10 may flow to the end portion 11 or the end portion 12 shown in FIG. 2, and may flow out from the end portion 11 or the end portion 12. In addition, the lubricant M may be applied in an unstable manner to the inner peripheral surface 14 of the fixing belt 10. Furthermore, the lubricant M may oxidize when it is exposed to a space.

The joint rib 50 disposed on the upstream side portion 48 collects the lubricant M applied to the inner peripheral surface 14 of the fixing belt 10, and re-supplies the lubricant M to the inner peripheral surface 14 of the fixing belt 10.

According to the present embodiment, with the configuration where the joint rib 50 is disposed on the upstream side portion 48, it is possible to restrict the oxidation of the lubricant M, and restrict the lubricant M from flowing out from the end portion 11 or the end portion 12. Furthermore, with the configuration where the joint rib 50 is disposed on the upstream side portion 48, it is possible to apply the lubricant M to the inner peripheral surface 14 of the fixing belt 10 in a stable manner.

Furthermore, according to the present embodiment, with the configuration where the joint rib 50 is disposed on both the downstream side portion 46 and the upstream side portion 48, it is possible to further suitably circulate the lubricant M between the fixing belt 10 and the heater holding member 40.

Embodiments of the present disclosure have been described above with reference to the accompanying drawings. However, the present disclosure is not limited to the above-described embodiments, but may be implemented in various manners without departing from the scope of the present disclosure. In the drawings, the components are shown schematically for easy understanding, and the components are drawn as different from the actual ones in thickness, length, number, and so on for the sake of drawing. In addition, the material, shape, measurement and the like of each component are not limited to those described in the embodiments, but may be varied without departing from the effect of the present disclosure.

The present disclosure is applicable to the fields of the fixing device and the image forming apparatus.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing belt configured to fix toner to a sheet;

a pressure applying member forming a nip portion together with an outer peripheral surface of the fixing belt and configured to cause the fixing belt to peripherally rotate while applying pressure to the fixing belt at the nip portion; and a heater holding member holding a heater that applies heat to the fixing belt, wherein the heater holding member includes:

a side portion extending from the nip portion along an inner peripheral surface of the fixing belt and configured to guide the fixing belt;

a plurality of pairs of inclined ribs that are disposed on the side portion to face the inner peripheral surface and are formed such that an interval between the inclined ribs in each pair is gradually narrowed as the inclined ribs proceed in a direction in which the fixing belt peripherally rotates; and a plurality of joint ribs at each of which the inclined ribs in each pair join, and the plurality of joint ribs are disposed along a width direction of the fixing belt.

2. The fixing device according to claim 1, wherein each of the plurality of joint ribs includes a storage portion configured to store lubricant.

3. The fixing device according to claim 1, wherein each of the plurality of joint ribs includes a joint portion configured such that lubricant accumulates therein, and the joint portion supplies the lubricant to the fixing belt.

4. The fixing device according to claim 3, wherein the joint portion is inclined toward a downstream in a direction in which the fixing belt peripherally rotates.

5. The fixing device according to claim 1, wherein the side portion includes a downstream side portion extending from the nip portion toward a downstream in a direction in which the fixing belt peripherally rotates, and the plurality of joint ribs are disposed on the downstream side portion.

6. The fixing device according to claim 1, wherein the side portion includes an upstream side portion extending from the nip portion toward an upstream in a direction in which the fixing belt peripherally rotates, and the plurality of joint ribs are disposed on the upstream side portion.

7. An image forming apparatus comprising:

the fixing device according to claim 1; and an image forming portion configured to form an image on the sheet.

* * * * *